US005844517A

United States Patent [19]

Lambropoulos

[11] Patent Number: 5,844,517

[45] Date of Patent: Dec. 1, 1998

[54] PORTABLE TRANSCEIVER FOR KEYLESS VEHICLE ENTRY SYSTEM HAVING PHASE DELAY

[75] Inventor: George P. Lambropoulos, Grosse Pointe Woods, Mich.

[73] Assignee: TRW Inc., Lyndhurst, Ohio

[21] Appl. No.: 595,748

[22] Filed: Feb. 2, 1996

[51] Int. Cl.[6] ..... G08C 19/12

[52] U.S. Cl. ..... 341/176; 340/825.54; 340/825.69; 340/825.72

[58] Field of Search ..... 341/176; 340/825.31, 340/825.3, 825.34, 825.54, 505, 825.69, 825.72; 307/10.1

[56] References Cited

U.S. PATENT DOCUMENTS 4,495,496 1/1985 Miller ..... 340/825.54
4,763,121 8/1988 Tomoda et al. ..... 340/825.54
5,319,364 6/1994 Waraksa ..... 340/825.31
5,508,687 4/1996 Gebhardt ..... 340/825.31

*Primary Examiner*—Jeffery Hofsass
*Assistant Examiner*—Albert K. Wong
*Attorney, Agent, or Firm*—Tarolli, Sundheim, Covell Tummino & Szabo

[57] ABSTRACT

A keyless entry system is presented for controlling a vehicle device function, such as the locking-unlocking functions of a vehicle door lock. The system includes a vehicle transceiver adapted to be mounted on a vehicle for transmitting an interrogation signal and also for receiving a coded reply signal and responding thereto for causing performance of a vehicle device function. The system also includes a plurality of portable remote transceivers, each of which receives an interrogation signal and responds thereto by transmitting a coded reply signal. The coded reply signals from different portable transceivers have different phase delays.

18 Claims, 5 Drawing Sheets

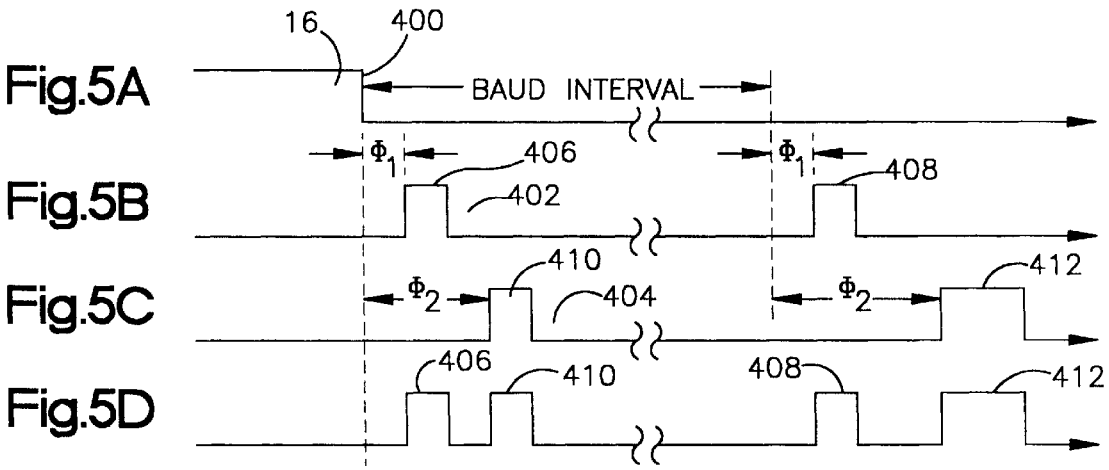
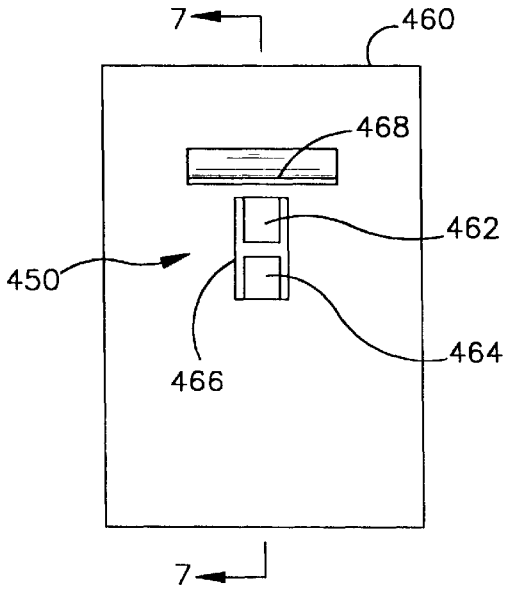
Fig.6
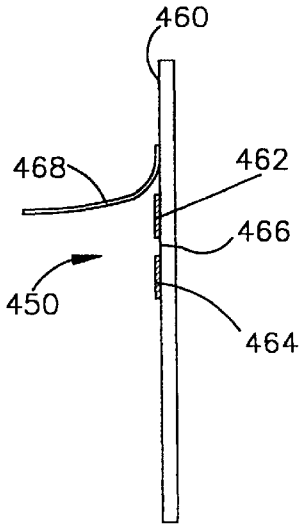
Fig.7

PORTABLE TRANSCEIVER FOR KEYLESS VEHICLE ENTRY SYSTEM HAVING PHASE DELAY

FIELD OF THE INVENTION

The present invention relates to the art of remote keyless entry systems for controlling the locking and unlocking functions of a vehicle door lock and the like and, more particularly, to an improved system wherein each of a plurality of portable transceivers sends reply signals to a vehicle transceiver such that the signals from different portable transmitters have different phase delays.

DESCRIPTION OF THE PRIOR ART

Keyless entry systems for motor vehicles are known in the art and typically serve to control the locking and unlocking functions of a motor vehicle door lock. Such a system is disclosed in the U.S. Patent to Tomoda et al. U.S. Pat. No. 4,763,121. That system operates vehicle devices such as door locks without the need for any manual operations of pushbuttons located on remote transmitters or the like. Instead, this system includes a vehicle mounted transceiver that periodically transmits an interrogating demand signal. A portable transceiver carried by an operator may receive the demand signal and respond by sending a reply signal back to the vehicle transceiver with the reply signal including a preset code that uniquely identifies one portable transceiver. At the vehicle transceiver, the preset code received from the remote transceiver is compared with a stored preset code and, if a match takes place, the requested control function, such as unlock a vehicle door, is accomplished.

In the Tomoda et al. keyless entry system discussed above, the vehicle transceiver communicates with a single remote transceiver. If two or more remote transceivers were used with such a system, the two remote transceivers might simultaneously respond to a demand signal transmitted by a vehicle transceiver. For example, each motor vehicle equipped with such a vehicle transceiver may have two or more remote transceivers for use by two or more members of the same family. In the event that two or more such transceivers respond simultaneously to such a demand signal, the reply signals may interfere with each other making it impossible for the vehicle's transceiver to properly discriminate between the reply signals.

SUMMARY OF THE INVENTION

In accordance with one aspect of the present invention, a keyless entry system is provided for controlling a vehicle device function such as the locking-unlocking functions of a vehicle door lock. The system includes a vehicle transceiver adapted to be mounted on a vehicle and having means for transmitting an interrogation signal and also having means for receiving a coded reply signal and responding thereto for causing performance of a vehicle device function. The system also includes a plurality of portable remote transceivers, each of which includes means for receiving an interrogation signal and responding thereto by transmitting a coded reply signal. The coded reply signals from different portable transceivers have different phase delays.

In accordance with another aspect of the invention, a portable transceiver is provided for use in a remote keyless vehicle entry system wherein two or more portable transceivers may each respond to an interrogating inquiry signal received from a commonly associated vehicle transceiver by transmitting to the vehicle transceiver a reply signal including a security code identifying the transmitting portable transceiver. Each portable transceiver receives the inquiry signal and responds thereto by transmitting a reply signal. Also, each portable transceiver delays the transmission of the reply signal after receiving the inquiry signal by a phase delay that is different from that for the other portable transceivers in the system.

BRIEF DESCRIPTION OF THE DRAWINGS

The foregoing and other objects of the invention will become more readily apparent from the following description of the preferred embodiment of the invention as taken in conjunction with the accompanying drawings which are a part hereof and wherein:

FIG. 5 is a schematic representation of various waveforms useful in understanding the way in which plural remote transceivers respond to an interrogation signal from a vehicle transceiver;

FIG. 6 is a plane view of a portable transceiver badge showing a program switch;

FIG. 7 is a view taken along line 7—7 looking in the direction of the arrows in FIG. 6;

DESCRIPTION OF PREFERRED EMBODIMENT

Figure 1:
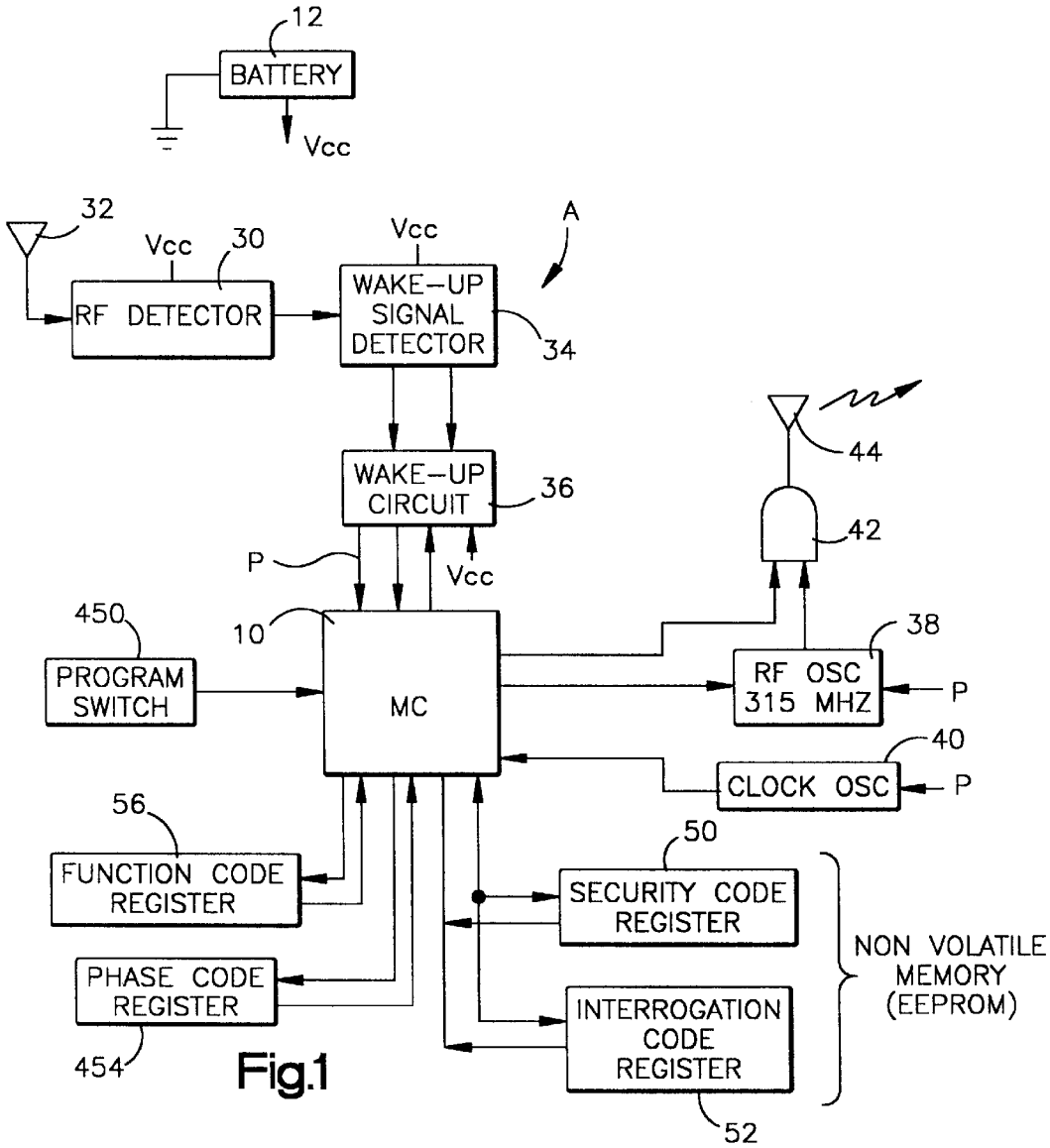
FIG. 1 is a schematic block diagram illustrating a portable transceiver in accordance with the present invention.

Reference is now made to the drawings wherein the showings are for purposes of illustrating a preferred embodiment of the invention only, and not for the purpose of limiting same. The keyless entry system described herein may include one or more remote, portable interactive transceivers which communicate with a vehicle transceiver to achieve remote control of the vehicle's door lock and unlock mechanisms. The portable transceivers may include transceivers A and B (only the circuitry of transceiver A being described herein in detail). Each takes the form as illustrated with respect to transceiver A in FIG. 1. This portable transceiver, sometimes referred to hereinafter as an interactive badge, may comprise a printed circuit located on a flat plastic base. The transceiver may have an appearance of a typical credit card and may be kept in the operator's purse or wallet or the like. A miniature battery is employed for providing operating power.

Each of the remote transceivers A and B is assigned a security code unique to the particular transceiver. Each vehicle transceiver C is mounted on a vehicle and will permit entry into the vehicle of an operator carrying a transceiver which is coded with a proper security code. In the example being given, transceivers A and B are provided with proper security codes SCA and SCB, respectively, which will permit entry into the vehicle in which is mounted transceiver C. As will be brought out in greater detail below, transceiver C periodically transmits an interrogation signal over a range of approximately two to four meters. The interrogation signal includes an interrogation code that uniquely distinguishes vehicle transceiver C from other vehicle transceivers. If an operator carrying a portable transceiver enters the range of operation of transceiver C, then the interrogation signal will be received by the transceiver.

Assume that an interrogation signal has been received by transceiver A. At transceiver A, the received interrogation code is compared with a prestored interrogation code and, if a match takes place, then transceiver A sends a reply signal back to the vehicle transceiver C. This reply signal includes a security code that uniquely identifies transceiver A, distinguishing it from all other similar transceivers, together with a function code requesting a function, such as the unlocking or opening of the vehicle door. This reply signal is received at the vehicle transceiver C where the received security code is compared with a prestored security code to ensure that the reply is from an access-authorized transceiver. If the received and prestored security codes match, then transceiver C responds to the function code by performing the requested functions, such as unlocking the vehicle door.

Having briefly described the operation of the keyless entry system, attention is now directed to the following more detailed description of a portable transceiver and a vehicle transceiver constructed in accordance with the present invention.

Portable Transceiver

Each portable transceiver takes the form of transceiver A as illustrated in FIG. 1. Transceiver A includes a microcomputer 10 having appropriate internal PROMs, EEPROMs, and RAMs programmed to perform the functions of the system, as hereinafter described, and having sufficient I/O terminals for interconnection with input and output peripherals. A battery 12 which may take the form of a long life miniature battery, such a lithium battery, provides a DC voltage to the various circuits shown in FIG. 1.

The microcomputer also includes a number of internal registers which are used during program execution for storage and manipulation of data and instructions. Individual storage locations in RAM or EEPROM are also sometimes used as such registers. Whereas these registers are internal of the microcomputer 10, several of the registers are illustrated in FIG. 1 external to the microprocessor to assist in the explanation of the invention. The illustrated registers include a security code register 50 and an interrogation code register 52, both of which are preferably located in the EEPROM memory. An additional register illustrated in FIG. 1 is function code register 56. Register 56 is preferably located in RAM. The security code register 50 contains a code which uniquely identifies transceiver A. The security code is fixed in the security code register 50 by the manufacturer. This may be accomplished in the manner described in U.S. Pat. No. 4,881,148. The security code preferably takes the form of four, eight bit bytes. The security code is generated at the point of manufacture by means of an algorithm which has the capability of generating numbers in a random, but not repeatable, fashion. Thus, each security code is unique.

The interrogation code register 52 contains a vehicle code which is twenty bits in length and provides an identification that uniquely distinguishes the vehicle transceiver C from other, similar vehicle transceivers. This vehicle code is entered into the register 52 during a program period to be described hereinafter.

The function code register 56 serves to temporarily store the function code to be transmitted as part of the transmitted signal from the transceiver A to the vehicle transceiver C. The function code is an eight bit byte wherein each bit corresponds to a particular function which may be requested, such as unlocking of the vehicle door.

Figure 3:
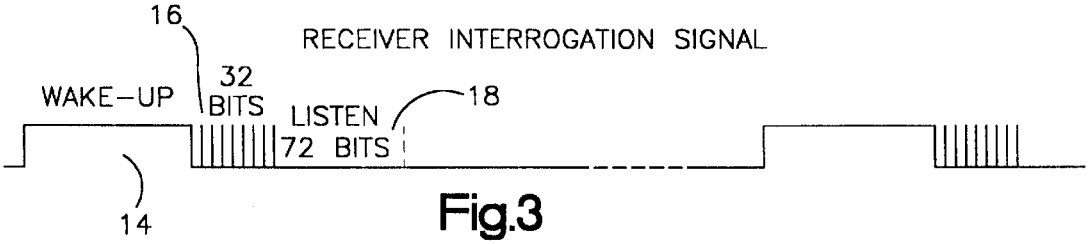
FIG. 3 is an illustration of voltage with respect to time illustrating the waveform of an interrogation signal transmitted by the vehicle transceiver.

As will be discussed in greater detail hereinafter, the vehicle transceiver C (FIG. 2) periodically transmits a radio frequency (RF) interrogation signal over a range on the order of two to four meters from the vehicle. The RF interrogation signal is an RF carrier signal which is keyed by a baseband digital interrogation signal having a pattern as shown in FIG. 3. In FIG. 3, a signal "high" level indicates that the RF carrier signal is keyed "on" and a "low" level indicates that the RF carrier signal is keyed "off". As shown in the waveform of FIG. 3, the digital control signal includes a wake-up portion 14, an interrogation portion 16 and a listen portion 18. The RF interrogation signal has a duration on the order of 355 milliseconds and is repeated every 1.95 seconds. The wake-up portion 14 is simply the carrier signal modulated at the baud rate but without any data carried thereon. The wake-up portion 14 serves to wake up the receiving portable transceiver, such as transceiver A.

The wake-up portion, which may have a duration on the order of 303 milliseconds, is followed by 32 bits of information transmitted over an interval on the order of 16 milliseconds. This 32 bits of information includes 20 bits of vehicle identification information, sometimes referred to as a vehicle code, followed by a four bit request code identifying the type of request being transmitted. This may be followed by a checksum code for purposes of providing verification of the accuracy of the transmitted signal, in a known manner.

The transceiver A includes an RF detector 30 which is tuned to the carrier frequency of the RF interrogation signal transmitted by the transceiver C. The carrier frequency is on the order of 315 MHz. As the interrogation signal is received at the transceiver's receiving antenna 32, the detector 30 demodulates the signal to recover the baseband digital interrogation signal, and passes the recovered signal to a wake-up signal detector 34. The wake-up signal detector 34 checks to see if the BAUD rate is proper, and if so, it activates a wake-up circuit 36 for supplying power P to the transceiver's microcomputer 10 as well as to oscillators 38 and 40.

The data in the recovered interrogation signal (FIG. 3) is clocked into the microcomputer 10. The data includes the 32 bit interrogation portion 16 which, as discussed hereinbefore, includes twenty vehicle identification bits. After the full 32 bits are received and stored in a register in the microprocessor, the microprocessor compares the interrogation or identification code with the code stored in the interrogation code register 52. If a match occurs then, under program control, the transceiver A transmits a badge reply signal (see FIG. 4).

The carrier oscillator 38 has a nominal frequency of 315 MHz and is employed for transmitting the reply signal from the remote transceiver A back to the vehicle transceiver C, as will be discussed in detail hereinafter. Other carrier frequencies can be used as required, i.e., 433.92 MHz for Europe. This is under the control of the microcomputer 10.

The reply signal (see FIG. 4) includes coded information in the form of binary 1 and binary 0 signals which are superimposed on the 315 MHz carrier signal. The carrier signal supplied by oscillator 38 is modulated by gating it through AND gate 42. The modulated signal is coupled to a transmitting antenna 44 for broadcast. The reply signal transmitted by the transceiver A has a range on the order of two to four meters.

Figure 4:
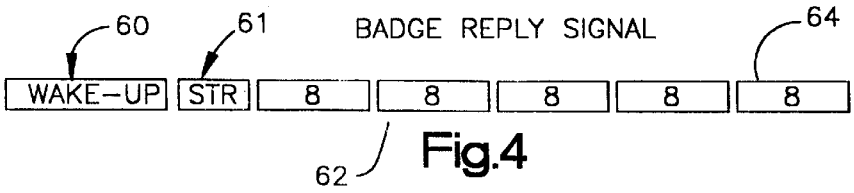
FIG. 4 is a schematic representation of a coded reply signal transmitted by a portable transceiver.

The badge reply signal, as shown in FIG. 4, includes a wake-up portion 60, a start portion 61 (four bits), a security code portion 62 (four, eight bit bytes) and a function code portion 64 (eight bits). Additional bits may be employed in some applications, such as a rolling code application as described in my U.S. Pat. No. 5,442,341 which issued on Aug. 15, 1995. The security code is taken from security code register 50 and the function code from register 56. The function code stored in register 56 will depend upon the four bit request code contained in the interrogation signal. If the request code requests an "open door" reply code, then the function code will be the code which requests unlocking of the doors.

Vehicle Transceiver

The vehicle transceiver C (FIG. 2) includes an RF detector 70 tuned to the reply signal frequency of 315 MHz so that, as the signal is received at the transceiver's receiving antenna 71 during the listening period (FIG. 2), the detector 70 allows the first portion 60 (FIG. 4) to pass to a wake-up signal detector 72 which checks to see if the BAUD rate is proper. If the BAUD rate is proper, detector 72 activates the wake-up circuit 74 which powers-up the circuit by supplying operating voltage $V_{cc}$, such as 5.0 volts, to the transceiver's microcomputer 80. The operating voltage is monitored by a low voltage detector 82 to permit operation of the circuitry so long as the voltage does not drop below a selected level.

The recovered base band data from the received signal is supplied to the microcomputer 80. The microcomputer 80, as in the case of the microcomputer 10 in the transceiver A, includes a plurality of internal memories including PROMs, RAMs, and EEPROMs and a number of internal registers. The microcomputer is programmed to perform the functions to be described in greater detail hereinafter.

Figure 2:
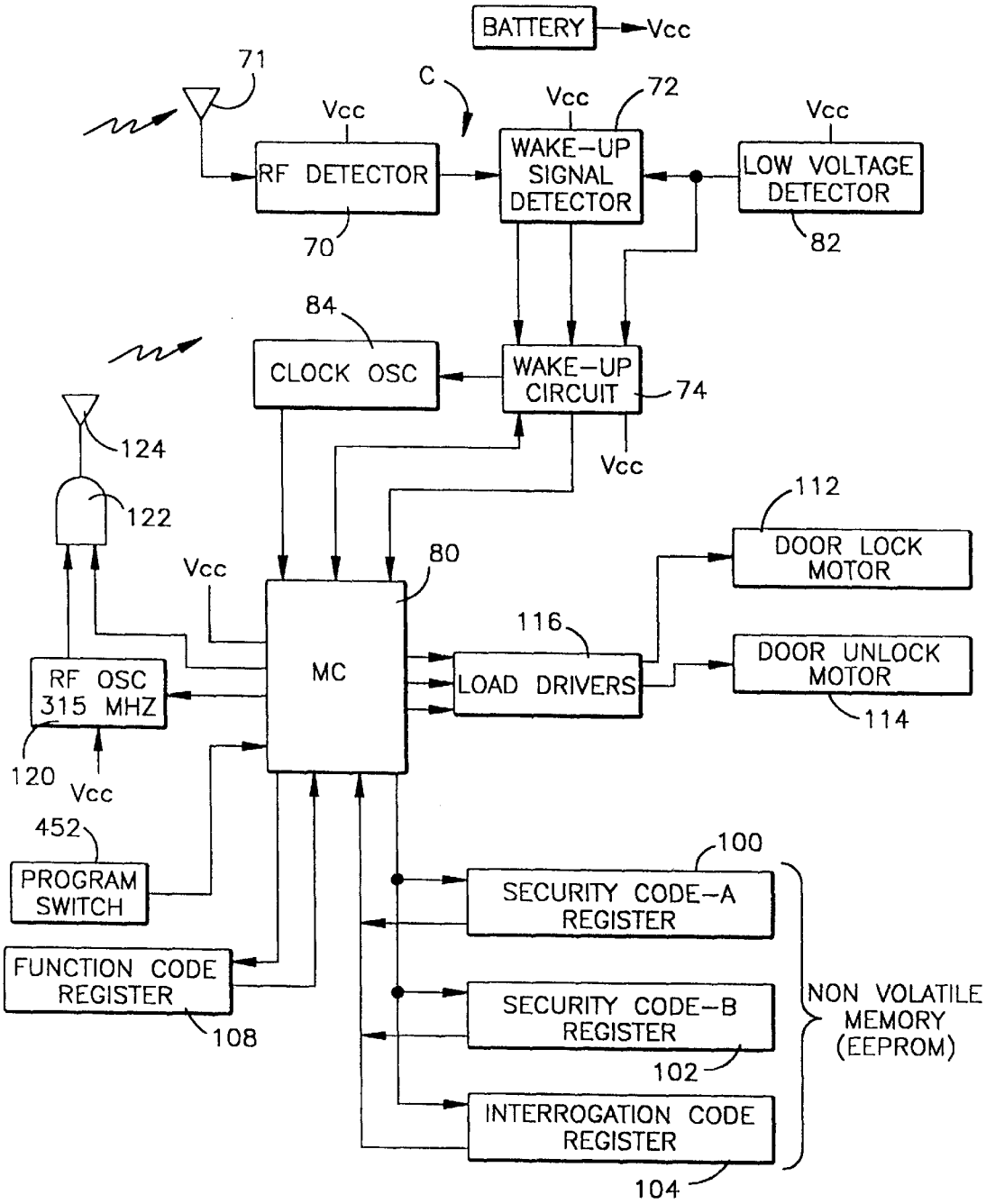
FIG. 2 is a schematic block diagram of a vehicle transceiver in accordance with the present invention.

Some of the internal memory locations of the microcomputer 80 are illustrated in FIG. 2 to assist in the description of the invention. These include registers 100, 102 and 104, which are all preferably part of the programmable but nonvolatile memory (EEPROM). Register 100 stores a security code identifying a transceiver (e.g., transceiver A) authorized to gain access to the vehicle. The code set into register 100 is programmed in the field as will be described later herein. This code is 32 bits in length and is divided into four, eight bit data bytes.

As it may be desirable for the vehicle transceiver C to recognize more than one authorized portable transceiver, a second security code register 102 is provided, identical to register 100. Register 102 will store a different security code identifying a second, different, authorized portable transceiver (e.g., transceiver B). An example of an application for security codes assigned to two different portable transceivers is a vehicle having two drivers authorized to use the vehicle. There may be several valid drivers, such as various members of a family unit, and in such case each member carries a different portable transceiver with its own unique security code. At transceiver C, various security code registers (there may be two, as illustrated, or more) each store a security code for a respective one of the authorized portable transceivers.

In addition to the security code registers 100 and 102, the vehicle transceiver C includes an interrogation code register 104 which contains identification data which uniquely identifies the vehicle transceiver C, distinguishing it from similar transceivers mounted in other vehicles. In the example being described, the vehicle identification information is twenty bits in length.

The transceiver C also includes a function code register 108. This register provides temporary storage of the function code portion of the digital signal received from a portable transceiver, such as transceiver A. If transceiver C receives a valid digital signal from transceiver A, then the microcomputer 80 will decode the function code in register 108 and perform a door lock function, such as lock or unlock a vehicle door by way of suitable motors 112 and 114 driven by load drivers 116. This process will now be described in greater detail.

The vehicle transceiver C periodically transmits an interrogation signal as illustrated in FIG. 3. That signal includes data in the form of a series of binary signals, superimposed on a 315 MHz carrier provided by oscillator 120. The carrier signal is modulated by gating it through an AND gate 122 under control of the microcomputer. The resulting amplitude modulated signal is transmitted from the transmitting antenna 124 in a known manner.

Transceiver A receives the interrogation signal and processes it in the manner already described and, if the interrogation code received from transceiver C matches that which is prestored at the register 52 in transceiver A, transmits a reply signal back to transceiver C. Upon receipt of the reply signal, transceiver C compares the reply security code with the codes stored in registers 100 and 102. That reply signal includes a function code which is clocked into the microcomputer 80 and stored in the function code register 108. The function code now received as part of the reply signal requests that the vehicle door be unlocked. Thus, when an operator carrying transceiver A enters the range of the interrogation signal transmitted by transceiver C, the doors of the vehicle automatically unlock.

To summarize the process described so far, the transceiver C periodically transmits an interrogation signal, searching for an operator with a valid interactive, portable transceiver and who desires entry into the vehicle. The interrogation signal includes twenty identification bits together with four request code bits which identify sixteen different requests. The request code is now a code which requests that a portable transceiver send a reply code asking for the doors to be unlocked. The transceiver A, in response to the received interrogation signal, transmits a badge reply signal as shown in FIG. 4. That reply signal includes a function code, see function code portion 64 in FIG. 4, which requests that the vehicle door be unlocked. In response thereto, the transceiver C activates the door unlock motor 114 to unlock the vehicle's doors. The operator may now enter into the vehicle.

After the operator has finished using the vehicle and exits therefrom, the transceiver C will revert to its normal operation of automatically and periodically transmitting an interrogation signal (see FIG. 3) which is effective over a range within approximately two meters from the vehicle. As long as a proper reply signal is received, no action is taken by transceiver C. As the operator possessing the transceiver walks away from the vehicle beyond the effective range of the interrogation signal, then no reply signal is sent back to the transceiver C. The microcomputer 80 in the transceiver C responds to the lack of reply by activating the door lock motor 112 to lock the vehicle doors. To prevent the doors from locking, prematurely, due to noise corrupted reply signals, the microcomputer 80 might be programmed to wait until two or three lack of replies take place. The transceiver C will continue to periodically transmit an interrogation signal awaiting a valid reply from a remote transceiver, such as transceivers A and B to allow entry into the vehicle. Following receipt of a valid reply, transceiver C will unlock the doors.

The portable transceivers or badges A and B are each constructed as illustrated with respect to badge A illustrated in FIG. 1 and discussed hereinabove.

In accordance with the present invention, the badges are programmed to respond to a received interrogation signal (see FIG. 3) with a badge reply signal (see FIG. 4) wherein the bits of the reply signal are transmitted with a phase delay that is different from that of the bits of the badge reply signal from any of the other badges associated with the same vehicle transceiver C. This is shown in the waveform of FIG. 5(*a*) which illustrates an interrogation signal transmitted by the vehicle transceiver C. This waveform illustrates the last bit of portion 16 as having a falling edge 400. The waveform of FIG. 5(*b*) shows a portion 402 of the response by badge A whereas the waveform of FIG. 5(*c*) shows a portion of the response of badge B. The response portion 402 of badge A is illustrated as including a first bit 406 and a second bit 408 These bits 406 and 408 have their leading edges spaced apart by a time length corresponding with the baud interval. This is the time delay between successive bits transmitted by badge A. It is to be noted that the waveform of FIG. 5(*c*) illustrates response portion 404 of badge B as including a first bit 410 and a second bit 412. These two bits also have their leading edges spaced apart by an interval corresponding with the baud interval noted in FIG. 5(*a*). In accordance with the present invention, the bits in the response portion 402 from badge A have a different phase delay relative to the lagging or falling edge 400 of the inquiry or interrogation signal 16. This phase delay is indicated by the symbol $\phi_1$. The bits 410 and 412 in the response portion 404 from badge B have a different phase delay $\phi_2$. These phase delays are sufficiently different from each other that the bits from the two responses 402 and 404 do not interfere with each other. That is, if badges A and B simultaneously receive the interrogation signal 16 from the vehicle transceiver C, then their responses as measured from the falling edge 400 of the interrogation signal will be out of phase from each other sufficient that the bits will not interfere with each other. This is shown by the composite waveform in FIG. 5(*d*) which shows bits 406, 410, 408, and 412 from badges A and B. It is noted that bit 412 is shown as being twice as wide as the remaining bits. In this example, the pulse width is indicative of whether the signal is representative of a binary "0" level or a binary "1" level. The narrow pulses 406, 408, and 410 all represent bits indicative of a binary "0" level whereas the wider pulse 412 represents a bit indicative of a binary "1" level.

It is seen from an inspection of FIG. 5 that the bits of the security codes in the coded reply signals transmitted by badges A and B associated with vehicle transceiver C are phased displaced and interleaved with one another in a time division multiple access ("TDMA") scheme. The vehicle transceiver will be able to distinguish between the respective security codes since they do not interfere with each other and the operation of the vehicle transceiver may be synchronized with the incoming signals so that they can monitor each phase channel separately.

In FIG. 5, the bits of the badge reply signals are interleaved. Alternatively, the badge reply signals may be transmitted so that the coded reply signal from badge A is received first and then the coded reply signal from badge B is received. In this manner, the coded reply signals would be out of phase as opposed to just the bits of the security code portions being out of phase.

Referring again to FIG. 5, the signal interval noted as the "baud interval" in FIG. 5A is the interval between successive bits in a badge reply signal. The length of this interval depends upon the number of phase delays which must be accommodated and this, in turn, depends upon the number of badges which are used with the respective vehicle transceiver. The baud interval should be short so that messages can be communicated as quickly as possible. The vehicle transceiver knows the number of authorized badges and, therefore, may control the baud interval accordingly. That is, the vehicle transceiver is programmed to specify a baud interval in an inquiry signal. The badges are programmed such that they will respond with the proper baud interval as specified in the inquiry signal.

The portable transceivers or badges are programmed to respond to a particular vehicle identification code and with a particular phase delay which is entered during a programming session involving the various badges and the vehicle transceiver, all to be described in greater detail hereinafter. The vehicle transceiver and each badge may be set to a "program" mode. One badge at a time will be set to this mode. At a badge, this is achieved by actuating a suitable program switch 450 which is coupled to the microcomputer 10 of the badge (see FIG. 1). The program switch 450 will be described in greater detail with reference to FIGS. 6 and 7.

The vehicle transceiver may also be actuated to a "program" mode by a program switch 452 coupled to the microcomputer 80 of the vehicle transceiver C (FIG. 2). When the program switch 452 is actuated, the vehicle transceiver will transmit an inquiry signal containing the vehicle identification code and a particular phase delay. The badge being presented to the vehicle transceiver will receive and remember the vehicle identification code and the phase delay intended for that badge. The badge will then respond with its own identification code, sometimes referred to as a security code, the vehicle identification code with the response being delayed in phase by the phase delay associated with that badge. The first badge is then removed from the program mode by deactivating the program switch 450 associated therewith. The next badge, such as badge B, will then be set to the program mode by actuating the program switch 450 associated therewith. The inquiry signal next generated by the vehicle transceiver C will again contain the vehicle code of transceiver C but this time the inquiry signal will contain the next sequential phase delay associated with the next badge, such as badge B. The badge being presented (in this case the second badge B) will remember the vehicle code and the associated second phase delay and then will respond with a reply message including its own identification code and the vehicle identification code, all delayed by the second phase delay. This process will continue until all badges have been programmed.

The various phase delays associated with the various badges are retained in memory at the microcomputer 80 of the vehicle transceiver C. Thus, the first badge to be programmed receives the first phase delay, and the second badge to be programmed receives the second phase delay and so forth. These are referred to as phase $\phi_1$ and phase $\phi_2$ and so on. At each badge, the phase delay obtained from the vehicle transceiver C is stored in a phase code register 454 (FIG. 1). Consequently, when the badge responds to the inquiry during the programming mode, it will respond with a phase delay in accordance with the phase delay stored in register 454 for that badge.

Reference is now made to FIGS. 6 and 7 which illustrate one form that the portable badges A or B may take. The badge 460 illustrated in FIGS. 6 and 7 is a flat rectangular member having the appearance of a typical wallet size credit card. In addition to providing a housing for the circuitry of FIG. 1, this badge also contains the program switch 450. The program switch may take the form of a pair of metal contacts 462 and 464 mounted on a recessed surface 466 within the credit card. These contacts 462 and 464 are mechanically and electrically spaced apart from each other and normally serve as a "open" switch. In operation, an operator may lift a self-adhesive flap 468 to expose the contacts 462 and 464. Once it has been decided to place the badge in a "program" mode, the operator provides an electrical connection between the contacts 462 and 464 with a suitable metal object such as a paper clip or the like. This will "close" the switch to actuate the badge to its "program" mode. The switch is taken out of the "program" mode by removing the paper clip from contacts 462 and 464 so that it becomes an "open" switch.

Figure 8:
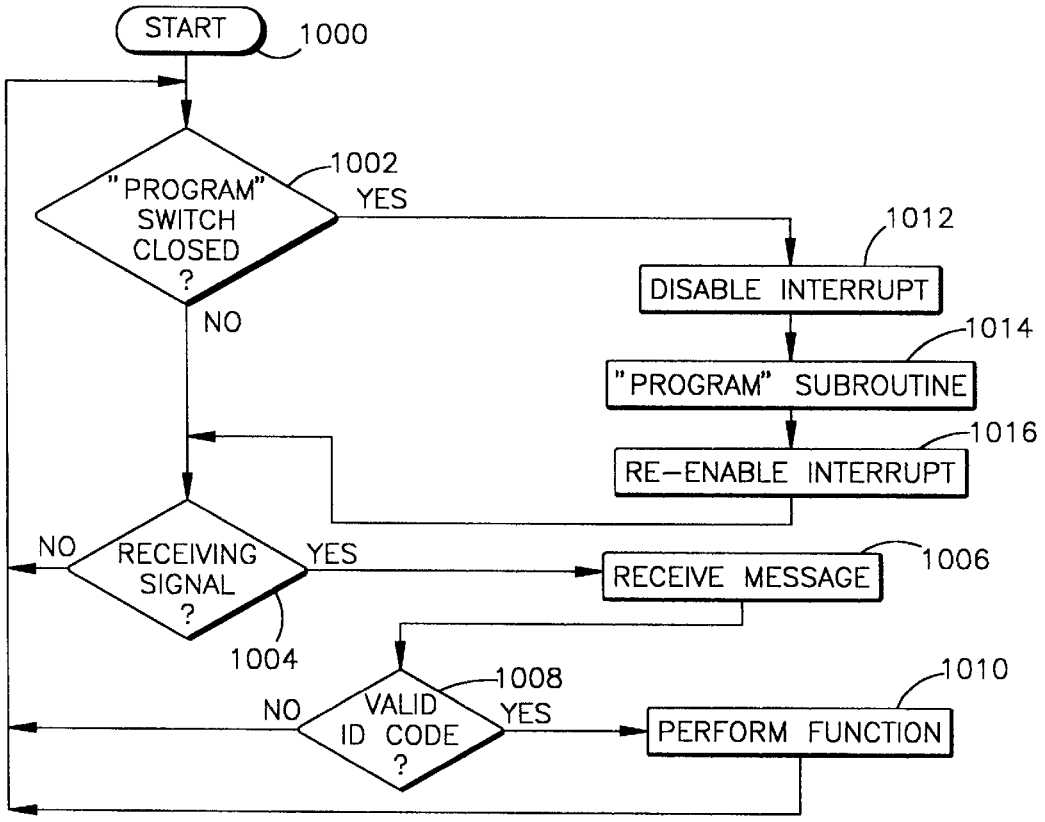
FIG. 8 is a flow chart illustrating a portion of the program performed by the microcontroller of the vehicle transceiver herein.

Reference is now made to FIG. 8 which illustrates a flow chart showing the manner in which the microcomputer 80 in the vehicle transceiver C is programmed. Initially, in step 1,000, the transceiver C is in a start condition in the vehicle main loop. In step 1,002, the vehicle transceiver determines whether the "program" switch 452 (FIG. 2) is closed. If the switch is not closed, then the microcomputer jumps to step 1,004 wherein a determination is made as to whether a reply signal is being received from a badge, such as badge A or badge B. If not, the procedure returns to step 1,002. If a signal is being received, then the microcomputer receives the message, such as a badge reply signal, in step 1,006. The message is then checked in the decision step 1,008 to determine whether it includes a valid badge identification code or security code identifying either badge A or badge B. During this determination, the microcomputer 80 in the vehicle transceiver checks to see whether the security code received matches either the security code in register 100 or in register 102 (FIG. 2). If not, the procedure returns to step 1,002. If a match does take place, the procedure advances to step 1,010 wherein the function requested by function code portion 64 of the reply signal is performed. This function, in the example herein, energizes door unlock motor 114 to unlock the vehicle doors.

Figure 9:
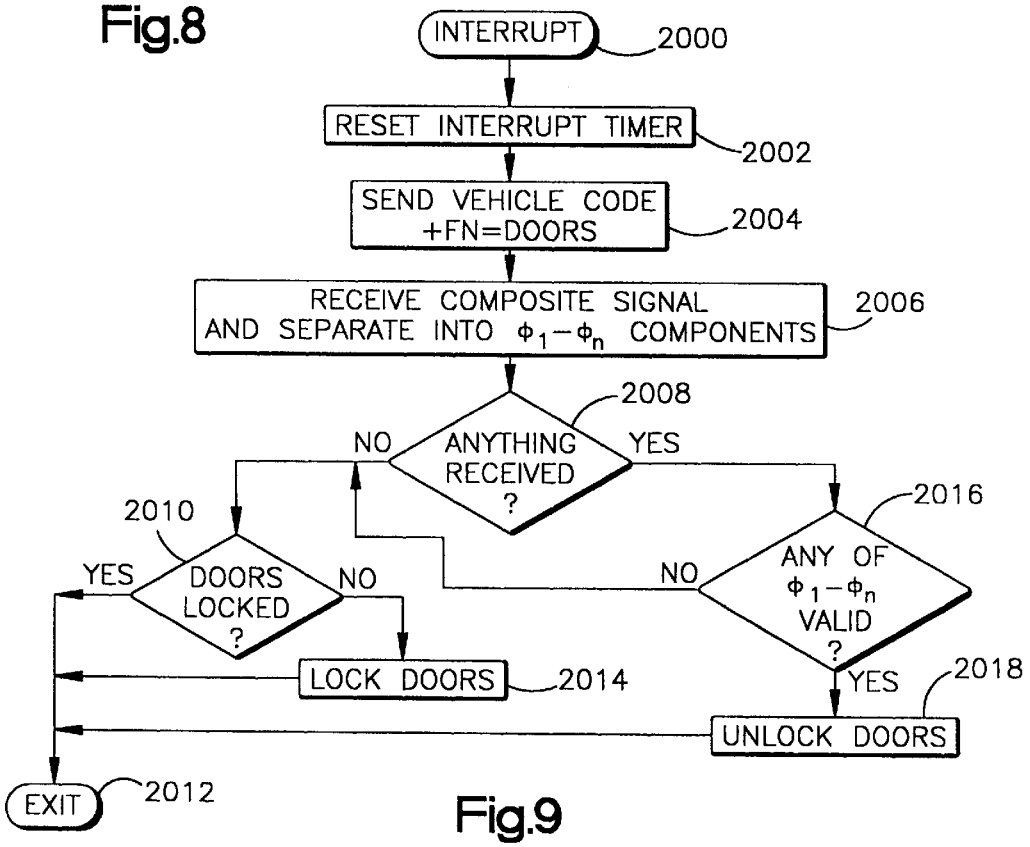
FIG. 9 is a flow chart illustrating an interrupt servicing routine performed by the microcontroller of the vehicle transceiver herein.

In step 1,002, a "yes" answer to the determination of whether the "program" switch 452 is closed results in the program advancing to step 1,012 at which the interrupt routine to be described with reference to FIG. 9 is disabled. The procedure then advances to the "program" sub-routine 1,014 to be discussed hereinafter with reference to FIG. 10. Thereafter, at step 1,016, the interrupt procedure is re-enabled.

Reference is now made to FIG. 9 which illustrates the vehicle interrupt servicing routine of the transceiver C. This interrupt routine commences at step 2,000 and proceeds to step 2,002 wherein it resets an interrupt timer within the microprocessor 80 to the time between successive receiver interrogation signals; about 1.95 in the example seconds being described. In step 2,004, the transceiver C transmits an interrogation signal, as shown in FIG. 3, which includes a vehicle identification code identifying transceiver C together with a function code such as unlock doors. Thereafter, in step 2,006, all portable transceiver badges, such as badges A and B, within the range of the signal transmitted from transceiver C respond with a badge reply signal such as that shown in FIG. 4. If two or more badges associated with transceiver C are within the range of the signal transmitted by transceiver C then they respond at the same time providing a composite reply signal as indicated by waveform 5(*d*). This is illustrated in FIG. 9 at step 2,006 wherein the microcomputer at the transceiver C separates the composite signal into its separate components based on the phase delays $\phi_1$–$\phi_N$.

In the decision step 2,008, a determination is made as to whether any reply signal has been received. If not, then the procedure advances to step 2,010 wherein a determination is made as to whether the doors are locked. If the doors are locked, then the routine proceeds to step 2,012 at which the procedure exits from this routine. If the decision at step 2,010 is negative, then the doors are locked, in step 2,014, by activating the load driver 116 to drive the door lock motor 112 to lock the vehicle doors (FIG. 2).

If in step 2,008, a determination is made that one or more badge reply signals is being received, then the procedure advances to step 2,016 wherein a determination is made as to whether any of the badge replies associated with phase delays $\phi$1–$\phi$N is valid. If one of the reply signals contains a valid security code with a properly associated phase delay, then the procedure advances to step 2,018 and causes the vehicle doors to be unlocked before exiting from the routine. If, in step 2,016, a determination is made that none of the received badge reply signals has a valid security code associated with a correct phase delay, then the procedure advances to the step 2,010 and the vehicle doors are locked before exiting from this routine.

Figure 10:
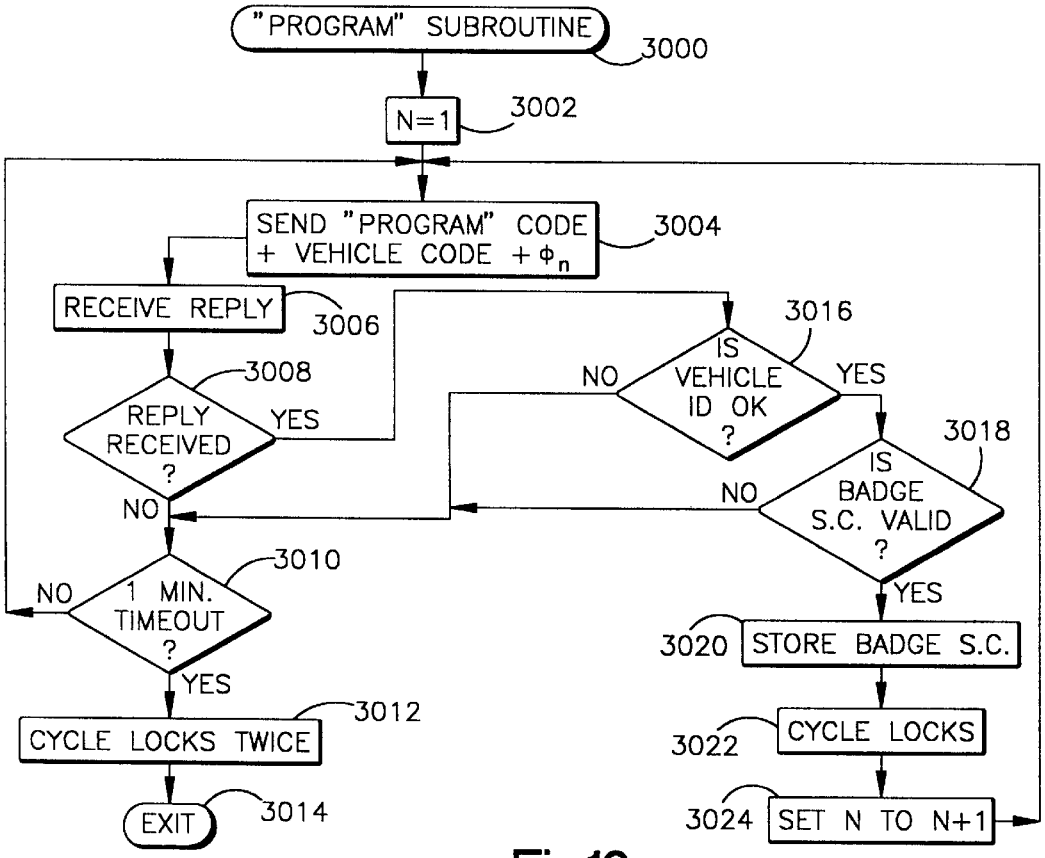
FIG. 10 is a flow chart illustrating a sub-routine performed by the microcontroller of the vehicle transceiver herein; and, FIG. 11 is a flow chart illustrating the operation of a remote portable transceiver badge disclosed herein.

Reference is now made to FIG. 10 which illustrates a flow chart showing the manner in which the microcomputer 80 in the vehicle transceiver C is programmed for the "program" sub-routine 1,014 in FIG. 8. As explained above, the program will only enter this subroutine when it is determined in step 1002 that someone has pressed the "program" button on transceiver C. This commences at step 3,000 and proceeds to step 3,002 wherein "N" is set to equal 1. "N" refers to the phase delay being programmed. The first badge to be programmed will be assigned the first phase delay $\phi_1$, whereas the second badge to be programmed will be assigned the second phase delay $\phi_2$ and so on. The first badge to be programmed is badge A and "N" is set at 1 so that badge A is assigned the first phase delay $\phi_1$. In step 3,004, the transceiver C transmits a "program" inquiry signal. The inquiry signal takes the form shown in FIG. 3 wherein the thirty-two bit portion 16 includes the vehicle transceiver identification, sometimes called the vehicle code, as well as the phase delay assigned to the badge being programmed. In the example being considered, badge A is the first badge to be programmed and is assigned phase delay $\phi_1$. Transceiver C listens for and receives a reply signal from badge A and this takes place during step 3,006. In step 3,008, a determination is made as to whether a badge reply signal is being received. If not, then in accordance with step 3,010, a determination is made whether a sufficient time has taken place, such as one minute, to provide enough time for the programming of the badge to be accomplished. If not, then the procedure returns to step 3,004. If the time is sufficient, then the procedure advances to step 3,012 during which the locks are cycled twice and then the procedure exits from this routine at step 3,014. The term "cycled twice" means that the doors are unlocked and then locked twice.

If, in step 3,008, a determination is made that a reply signal is being received, then the procedure advances to step 3,016 wherein a determination is made as to whether the vehicle identification code in the reply signal matches that of the vehicle identification code at the vehicle transceiver C. If not, then the procedure advances to step 3,010. If a match is determined, then the procedure advances to step 3,018 wherein a determination is made as to whether a badge security code is present in the badge reply signal. Thus, if badge A is being programmed then the reply signal, during the programming mode, includes the security code associated with badge A. If the determination provides a negative response, then the procedure advances to step 3,010. If a positive response is obtained in step 3,018, then the procedure advances to step 3,020 wherein the badge security code in the badge reply signal is stored in register 100 which is associated with the first phase delay $\phi_1$. To notify the operator that the programming mode for the first badge, such as badge A has been completed, the procedure in step 3,022 cycles the vehicle locks once. The procedure now advances to step 3,024 wherein "N" is set to "N+1" so that the next phase delay, such as phase delay $\phi_2$ is assigned to the next badge to be programmed and this continues until all of the badges associated with the vehicle transceiver C have been programmed.

In the "program" sub-routine discussed above with reference to the flow chart of FIG. 10 an additional procedure may be incorporated in one of the steps or added as an additional step. This is a procedure to eliminate a redundant badge situation when several badges are being programmed. Thus, assume three badges A, B, and D are being programmed. The first badge A is programmed so as to be associated with the first phase delay, $\phi_1$ and the second badge B is programmed so as to be associated with the second phase delay $\phi_2$. If the operator forgets that he has already programmed badge A and tries to program badge A (as badge D) for phase delay $\phi_3$, the result is that badge A has its security code stored in a first register (such as register 100) associated with phase delay $\phi_1$ and the same security code is also stored in a subsequent register (not shown in FIG. 2) associated with phase delay $\phi_3$. This is a redundant badge situation and may be eliminated by a procedure that compares each badge security code that is being stored with the badge security codes that have previously been stored, such as in registers 100 and 102, to determine whether the badge security code for the badge just programmed has been previously programmed for a particular phase delay. If so, then the procedure will clear or erase the security code in the first register, such as register 100, and only the last entry will be maintained in a third security code register (not shown in FIG. 2). Instead of setting "N" to "N+1", in step 3,024, "N" would be set to the phase delay number associated with the just cleared register; that is, set "N=1", which is the phase delay $\phi_1$ associated with register 100.

Figure 11:
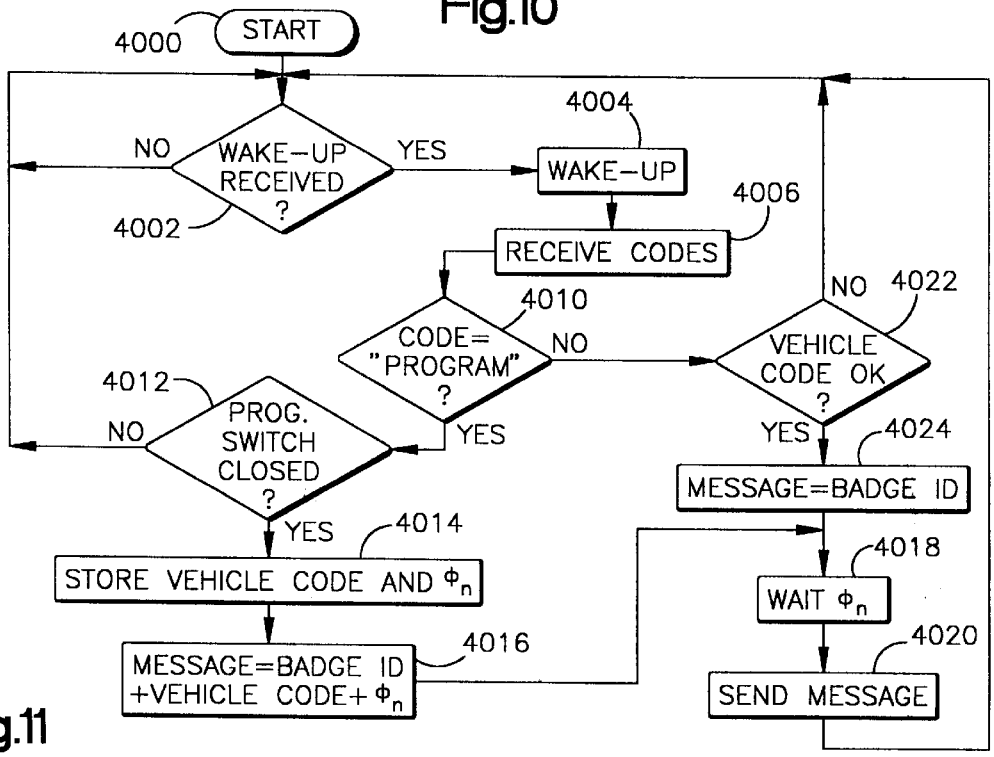

Reference is now made to FIG. 11 which illustrates the manner in which the microcomputer 10 in the portable transceiver of FIG. 1 is programmed in accordance with the present invention. Initially, in step 4,000, the portable transceiver badge is in a start condition waiting for an inquiry or interrogation signal from the vehicle transceiver C (see FIG. 3). In step 4,002, a determination is made as to whether a received signal includes a wake-up portion 14 (see FIG. 3) and if not, the procedure returns to wait for an incoming signal having such a wake-up portion. If a wake-up portion is received, then in accordance with step 4,004, the portable transceiver wakes up, as described earlier with reference to the wake-up signal detector 34 and wake-up circuit 36. Thereafter, in step 4,006, the inquiry portion 16 is received. This signal comprises the inquiry signal assembled by transceiver C in step 3004. The signal includes a vehicle identification code and a program code.

In step 4,010, a determination is made as to whether the codes received include a program code. This may be a one-bit code which may be high to indicate that the inquiry signal is a programming signal and low otherwise. If the answer is "yes", then the procedure advances to step 4,012 wherein a determination is made as to whether the program switch 450 (see FIGS. 1, 6, and 7) on the badge being programmed is closed. If not, then the procedure returns to step 4,002 to await receipt of a wake-up signal. If the "program" switch is closed, as with a paper clip bridging contacts 462 and 464, the procedure moves to step 4,014 during which the vehicle identification code obtained from the received signal along with the associated phase delay $\phi_N$ are stored in the memory registers associated with the microcomputer 10 in the badge (FIG. 1). Thus, the vehicle code is stored in the interrogation code register 52 and the code designating the associated phase delay $\phi_N$ is stored in the phase code register 454. If this is the first badge to be programmed, then the first phase delay $\phi_1$ is stored in register 454.

The procedure now moves to step 4,016 wherein the badge assembles the badge reply signal during the program mode. This badge reply signal includes the badge identification or security code, together with the vehicle code and the associated phase delay $\phi_N$ which were just stored in accordance with step 4,014. In accordance with step 4,018, a time delay corresponding with the associated phase delay $\phi_N$ takes place and then in accordance with step 4,020, the message assembled in step 4,016 is transmitted by the badge to the vehicle transceiver C and the procedure returns to step 4,002 to determine whether a wake-up signal is being received.

If, in step 4,010, a determination is made that a program code is not included in the signal received from the transceiver C, then the procedure advances to step 4,022 wherein a determination is made as to whether a vehicle identification code in the received message is valid. That is, the signal being received should include a vehicle code that matches the vehicle code stored in register 52 of the badge (see FIG. 1). If it is not the proper code, then the procedure returns to step 4,002. If the code is proper, then the badge assembles a reply message (FIG. 4) which, in accordance with step 4,024, includes the badge identification or security code 62 together with the function code 64. Thereafter, the procedure waits for the proper phase delay $\phi_N$ in accordance with step 4,018 and then transmits the badge reply signal, pursuant to step 4,020.

From the above description of the invention, those skilled in the art will perceive improvements, changes, and modifications. Such improvements, changes, and modifications within the skill of the art are intended to be covered by the appended claims.

Having described the invention, we claim the following:

1. A keyless vehicle entry system for controlling a vehicle device function including:

a vehicle transceiver having means for transmitting an interrogating inquiry signal and means for receiving a reply signal for causing performance of a vehicle device function; and, a plurality of portable transceivers, each having means for receiving said inquiry signal and means for responding thereto by transmitting said reply signal and each said portable transceiver including means for delaying the transmission of said reply signal after receiving said inquiry signal by a phase delay selected such that the reply signals received from different ones of said portable transceivers have different phase delays.

2. A system as set forth in claim 1, wherein each said portable transceiver includes memory means for receiving and storing a phase code representing the phase delay for said portable transceiver.

3. A system as set forth in claim 2 wherein each said portable transceiver includes field programming means having program switching means for initiating a program interval during which said memory means may receive and store said phase code.

4. A system as set forth in claim 3 wherein said program switching means is a manually operated switch.

5. A system as set forth in claim 3 wherein said programming means is operable during said program interval to store said phase code in said memory means.

6. A system as set forth in claim 5 wherein said vehicle transceiver has vehicle programming means for initiating a programming period during which said vehicle transceiver transmits a message to said portable transceiver with said message containing said phase code representing a first phase delay to be assigned to said portable transceiver.

7. A portable transceiver for use in a remote keyless vehicle entry system wherein two or more said portable transceivers respond to an interrogating inquiry signal received from a commonly associated vehicle transceiver by transmitting to said vehicle transceiver a reply signal including a security code identifying the transmitting portable transceiver and comprising:

means for receiving said inquiry signal and responding thereto by transmitting said reply signal; and, means for delaying the transmission of said reply signal after receiving said inquiry signal by a phase delay that is different than that of the other said portable transceivers in said system.

8. A portable transceiver as set forth in claim 7 wherein said delaying means includes memory means for receiving and storing a phase code representing the phase delay for said portable transceiver.

9. A portable transceiver as set forth in claim 8 including field programming means having program switching means for initiating a program interval during which said memory means may receive and store said phase code.

10. A portable transceiver as set forth in claim 9 wherein said program switching means is a manually operated switch.

11. A portable transceiver as set forth in claim 9 wherein said programming means is operable during said program interval to store the phase code in said memory means.

12. A portable transceiver as set forth in claim 9 in combination with a said vehicle transceiver having vehicle programming means including means for initiating a programming period during which said vehicle transceiver transmits a message to said portable transceiver with said message containing said phase code representing a first phase delay to be assigned to said portable transceiver.

13. A portable transceiver for use in a keyless vehicle entry system wherein two or more transceivers may each respond to an interrogating inquiry signal received from a commonly associated vehicle transceiver by transmitting to said vehicle transceiver a reply signal including a security code identifying the transmitting portable transceiver, comprising:

means for receiving said inquiry signal and responding thereto by transmitting said reply signal; and, said portable transceiver having means for delaying transmission of said reply signal by a preprogrammed phase delay that is unique to said portable transceiver and different from that which is preprogrammed in the other said portable transceivers in said system.

14. A portable transceiver as set forth in claim 13, wherein said portable transceiver includes memory means for receiving and storing a phase code representing the preprogrammed phase delay for said portable transceiver.

15. A portable transceiver as set forth in claim 14 including field programming means having program switching means for initiating a program interval during which said memory means may receive and store said phase code.

16. A portable transceiver as set forth in claim 15 wherein said program switching means is a manually operated switch.

17. A portable transceiver as set forth in claim 15 wherein said programming means is operable during said program interval to store said phase code in said memory means.

18. A portable transceiver as set forth in claim 17 in combination with a said vehicle transceiver having vehicle programming means including means for initiating a programming period during which said vehicle transceiver transmits a message to said portable transceiver with said message containing said phase code representing a first phase delay to be assigned to said portable transceiver.

* * * * *